US006390310B1

(12) United States Patent
Insalaco

(10) Patent No.: US 6,390,310 B1
(45) Date of Patent: May 21, 2002

(54) SHELF WITH MOVABLE BARRIER

(75) Inventor: Robert W. Insalaco, Holland, MI (US)

(73) Assignee: Herman Miller Inc., Zeeland, MI (US)

( * ) Notice: Subject to any disclaimer, the term of this patent is extended or adjusted under 35 U.S.C. 154(b) by 0 days.

(21) Appl. No.: 09/366,157

(22) Filed: Aug. 3, 1999

Related U.S. Application Data

(63) Continuation of application No. PCT/US98/02738, filed on Feb. 12, 1998.
(60) Provisional application No. 60/040,301, filed on Feb. 13, 1997.

(51) Int. Cl.[7] ..... A47F 5/00

(52) U.S. Cl. ..... 211/134; 211/183; 220/7

(58) Field of Search ..... 312/137, 139.1, 312/140.4, 323, 249.12, 249.13; 211/90.03, 106, 119.003, 181.1, 183, 184, 134; 108/27, 55; 5/430

(56) References Cited

U.S. PATENT DOCUMENTS

| | | | | |
|---|---|---|---|---|
| 17,910 A | * | 9/1857 | Hoskins | 5/430 |
| 2,195,955 A | * | 4/1940 | Hillenbrand | 5/430 |
| 2,669,373 A | | 2/1954 | Coit, Jr. | |
| 3,888,379 A | | 6/1975 | Folberth | |
| 3,941,271 A | | 3/1976 | Zarges et al. | |
| 3,981,410 A | | 9/1976 | Schurch | |
| 4,339,048 A | | 7/1982 | McMillen et al. | |

* cited by examiner

*Primary Examiner*—Peter M. Cuomo
*Assistant Examiner*—Jerry A. Anderson
(74) *Attorney, Agent, or Firm*—Brinks Hofer Gilson & Lione

(57) ABSTRACT

This invention is directed to a shelf assembly having a shelf, a mounting block and a barrier member. The shelf has a first edge. The mounting block is attached to the first edge. A barrier member is adapted to be attached to the mounting block. The barrier member is capable of being oriented in at least two positions with respect to the shelf. The two positions include an article retaining position and an article access position.

20 Claims, 7 Drawing Sheets

SHELF WITH MOVABLE BARRIER

RELATED APPLICATIONS

This application is a continuation of PCT/US98/02738 filed on Feb. 12, 1998, pursuant to 35 U.S.C. §§119(e) and 120, which claims benefit of provisional application No. 60/040,301 filed Feb. 13, 1997.

BACKGROUND OF THE INVENTION

The present invention relates generally to a movable barrier or fence for a shelving assembly. More particularly, the present invention relates to a shelving assembly having a pivotable barrier useful on a cart for transporting medical supplies within a hospital.

Healthcare organizations frequently use carts to transport medical supplies or containers within a hospital. In such carts, one or more shelves are used to support the supplies thereon. In addition, a fixed or non-movable fence has been used with these shelves in order to positively retain the supplies on the shelf. This is particularly important in a movable cart because unstable articles could fall off the cart while it is in transit.

Fixed fences, however, are sometimes undesirable. In particular, if a cart contains two relatively closely spaced shelves, a fixed fence could impede access to supplies located on the lower shelf. On the other hand, supplies could fall off the shelf in the absence of a fence. Accordingly, in order to avoid the increased costs associated with supplies being damaged and, more importantly, the delay in delivering supplies to the designated patient, there is a need for a shelf assembly for use with a cart that will overcome these problems.

SUMMARY OF THE INVENTION

This invention is directed to a shelf assembly having a shelf, a mounting block and a barrier member. The shelf has a first edge. The mounting block is attached to the first edge. A barrier member is adapted to be attached to the mounting block. The barrier member is capable of being oriented in at least two positions with respect to the shelf. The two positions include an article retaining position and an article access position.

According to another aspect of the present invention, a cart is provided for transporting materials along a floor. A base is positioned parallel to the floor and adapted to be attached to at least three wheels. A support structure is adapted to be attached to the base and extends upward therefrom. A shelf is adapted to be attached to the support structure. The shelf has a first edge and a mounting block attached thereto. A barrier member is adapted to be attached to the mounting block. The barrier member is capable of being oriented in at least two positions with respect to the shelf. The positions include an article retaining position and an article access position.

The present invention provides improved flexibility in storing medical supplies of a wide variety of sizes and shapes.

The present invention also provides a cart and shelving assembly that allows easy access to medical supplies while protecting them from accidental damage.

The invention, together with its further objects and attendant advantages, will be best understood by reference to the following detailed description taken in conjunction with the accompanying drawings.

DETAILED DESCRIPTION OF THE PREFERRED EMBODIMENTS

Figure 1:
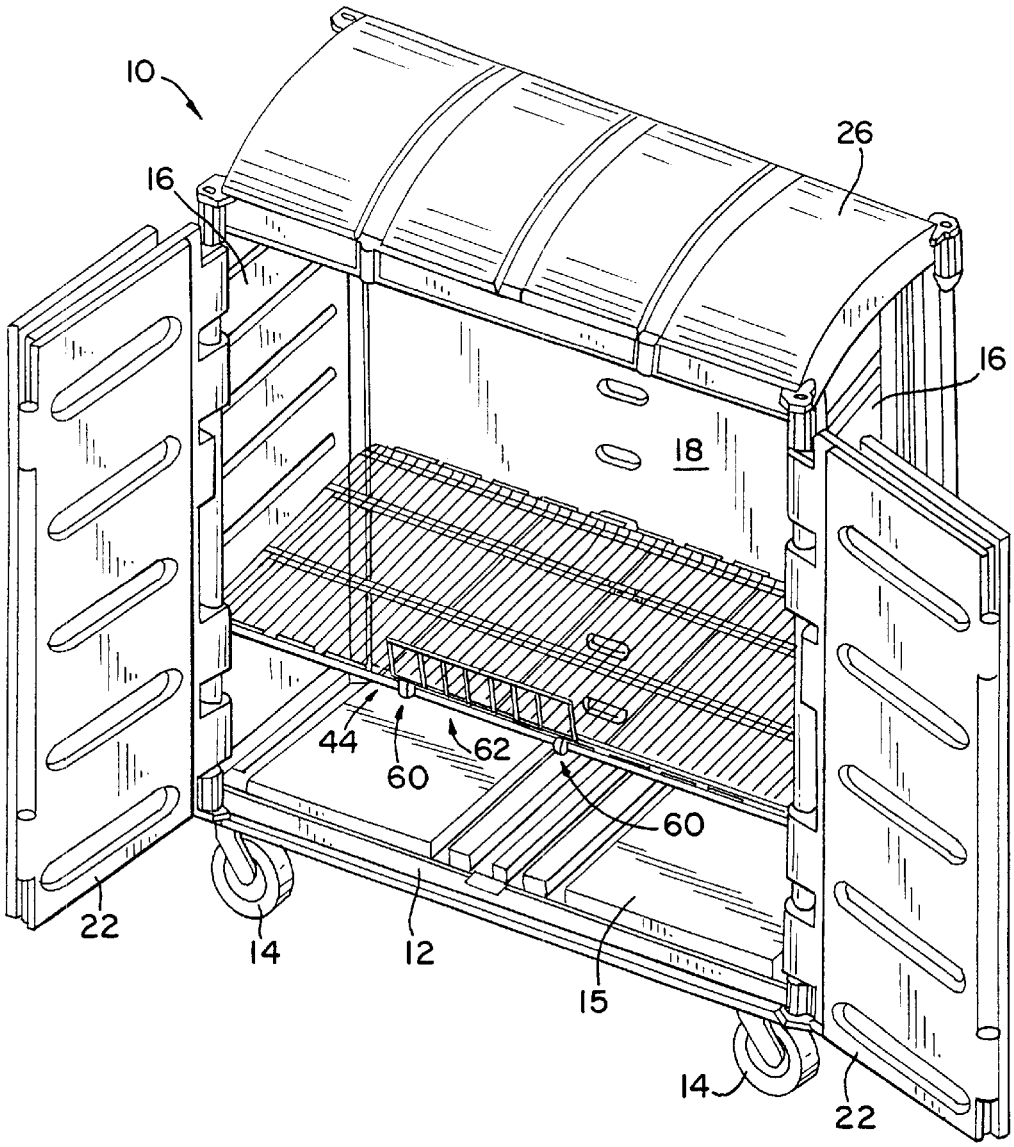
FIG. 1 is a front perspective view of a cart and shelf assembly illustrating a preferred embodiment of the present invention.
Figure 2:
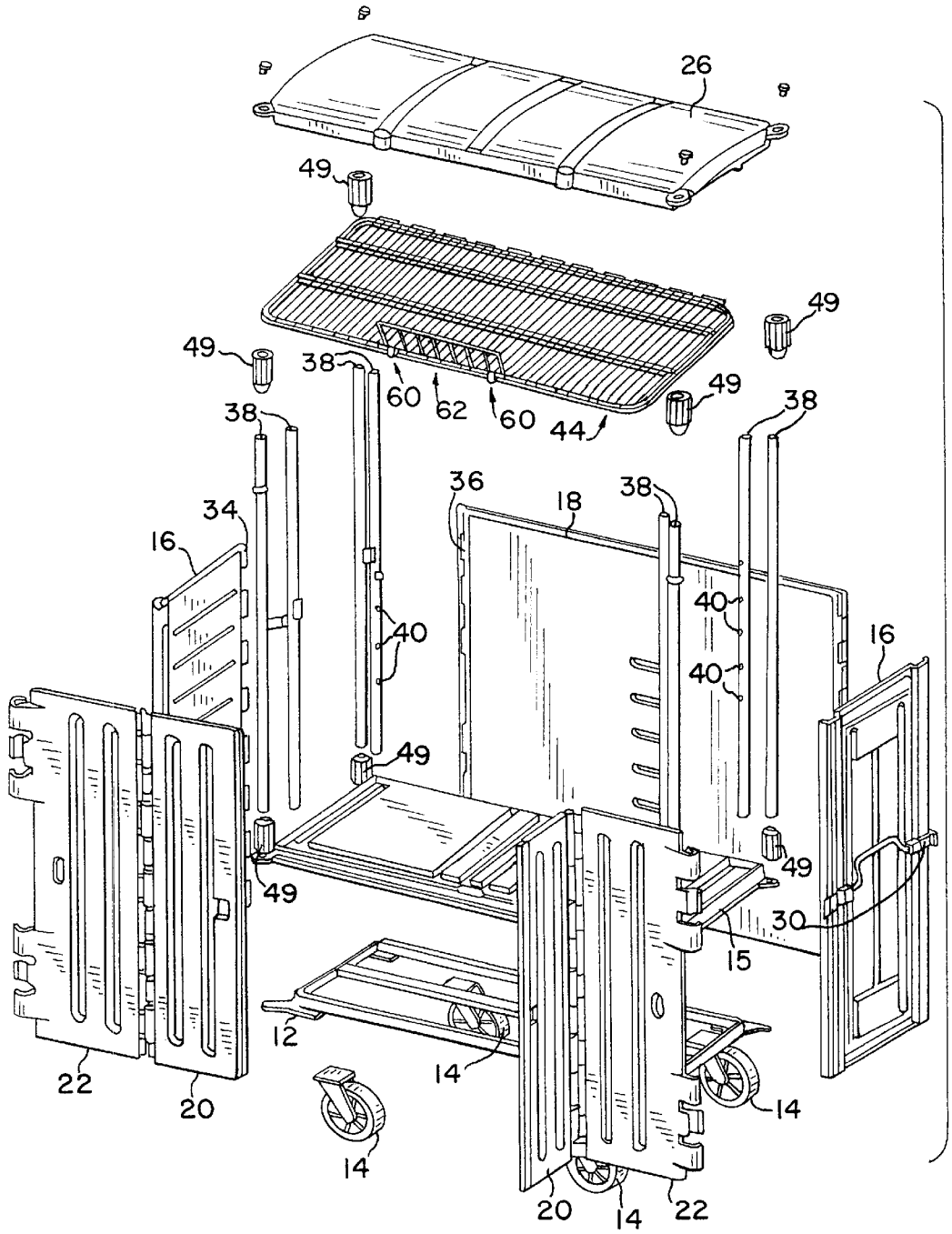
FIG. 2 is an exploded view of the cart shown in FIG. 1.

A cart 10 illustrating a first preferred embodiment of the present invention is shown in FIGS. 1–2. The cart 10 is useful in transporting hospital supplies or other materials along a floor or base surface. The cart 10 includes a base 12 attached to four wheels, such as 8 inch diameter casters 14. The casters 14 are mounted to the base 12 using well known attachment devices such as carriage bolts or welds. The base 12 is preferably rectangular in shape. The cart 10 also includes a floor 15, side walls 16, a back wall 18, inner and outer doors 20, 22 and a cover 26. A handle 30 may also be used to pull the cart 10.

To open to the cart 10, each inner door 20 opens and folds against the face of the corresponding outer door 22. The base 12, floor 15, side walls 16, back wall 18, inner doors 20, outer doors 22 and cover 26 are preferably formed from polyethylene plastic using a double wall vacuum process.

The double wall vacuum process is well known and comprises having two plastic sheets suspended on a rotary turntable. While the turntable rotates, the temperature of each plastic sheet is raised by a heating element until they soften. The softened plastic sheets are then placed over pre-heated upper and lower aluminum molds of the part to be formed, such as floor 15. A vacuum is applied to each mold resulting in a pre-heated sheet being sucked into each mold so that the plastic takes on the shape of the mold. Both molds are then clamped together under pressure. During the clamping process, the plastic sheets are fused to each other at places known as pinch points wherever the upper sheet and lower sheets contact each other when the mold halves come together. The fused pinch points increase the module of rigidity and strength of the part.

According to one preferred embodiment, the side walls 16 are rectangular in shape having a height of approximately 61", a width of approximately 61" and a thickness of approximately 1". The back wall 18 also is preferably rectangular in shape having a height of approximately 61", a width of approximately 61" and a thickness of approximately 1". The inner doors 20 preferably have a height, width and thickness of approximately 59", 15" and 1¼", respectively, while the outer doors 22 preferably have a height of approximately 59", a width of approximately 18" and a thickness of approximately 1¼". Of course, other shapes and dimensions for these elements are possible without departing from the spirit of the present invention. For further details of a preferred embodiment of the cart 10, reference is made to U.S. patent application Ser. No. 08/634,611, filed on Apr. 18, 1996 and assigned to Herman Miller, Inc., whose contents are hereby incorporated by reference.

Side walls 16 and back wall 18 each have alternating cylindrical hollow forms 34 and 36, respectively. Hollow forms 34 and 36 are offset from one another so that when side wall 16 and back wall 18 are brought together at their edges the hollow forms 34 and 36 intermesh with one another to form hollow cylindrical channels at each corner extending along the height of the walls. The walls 16, 18 are attached to each other by inserting rods into each of the hollow channels. Once they are attached to each other, the side walls 16 and back wall 18 provide structure to the cart 2 which prevents distortion in the cart which could affect door alignment.

Four inner frame members 38, or supports, such as four 1.25"diameter steel rods extend upward from the floor 15 and form the support structure for the cart 10. It should be understood that the support structure can have other shapes and be formed from other durable materials. It is understood that the frame members 38 can have other shapes without departing from the spirit of the invention. Furthermore, the frame members 38 can be made of other durable materials such as epoxy powder coat painted steel, chrome plated steel or stainless steel.

The frame members 38 include a plurality of spaced apart threaded apertures 40. Preferably, the apertures 40 are spaced apart approximately 6". Well known connectors are used to engage each comer of the shelf 44 and are threaded into one of the apertures 40. For example, a screw could be inserted between the spaced outer rods 48 and into one of the threaded apertures 40. A plastic, preferably Delrin™, spacer shaped to conform with a portion of the outer surface of an inner frame member 38 could also be inserted between the shelf 44 and the frame member 38. The spacer prevents scratching of the frame member 38. A clamping device could also be used to connect the shelf 44 to a frame member 38. For example, two aluminum brackets shaped to conform to the front and rear surfaces of the spaced outer rods 48 could be attached to shelf 44 adjacent the apertures 40. A screw could be inserted through apertures in the brackets and into an aperture 40 on the frame member 38. The screw would act to force the two brackets together and clamp the assembly to the frame member 38. A Delrin™ spacer could also be used with this device.

Each of the frame members 38 has a bumper 49 attached to the top and bottom of each of the frame members 38. Preferably, the bumpers 49 are injection molded and made from an energy absorbent material such as PVC.

Figure 3:
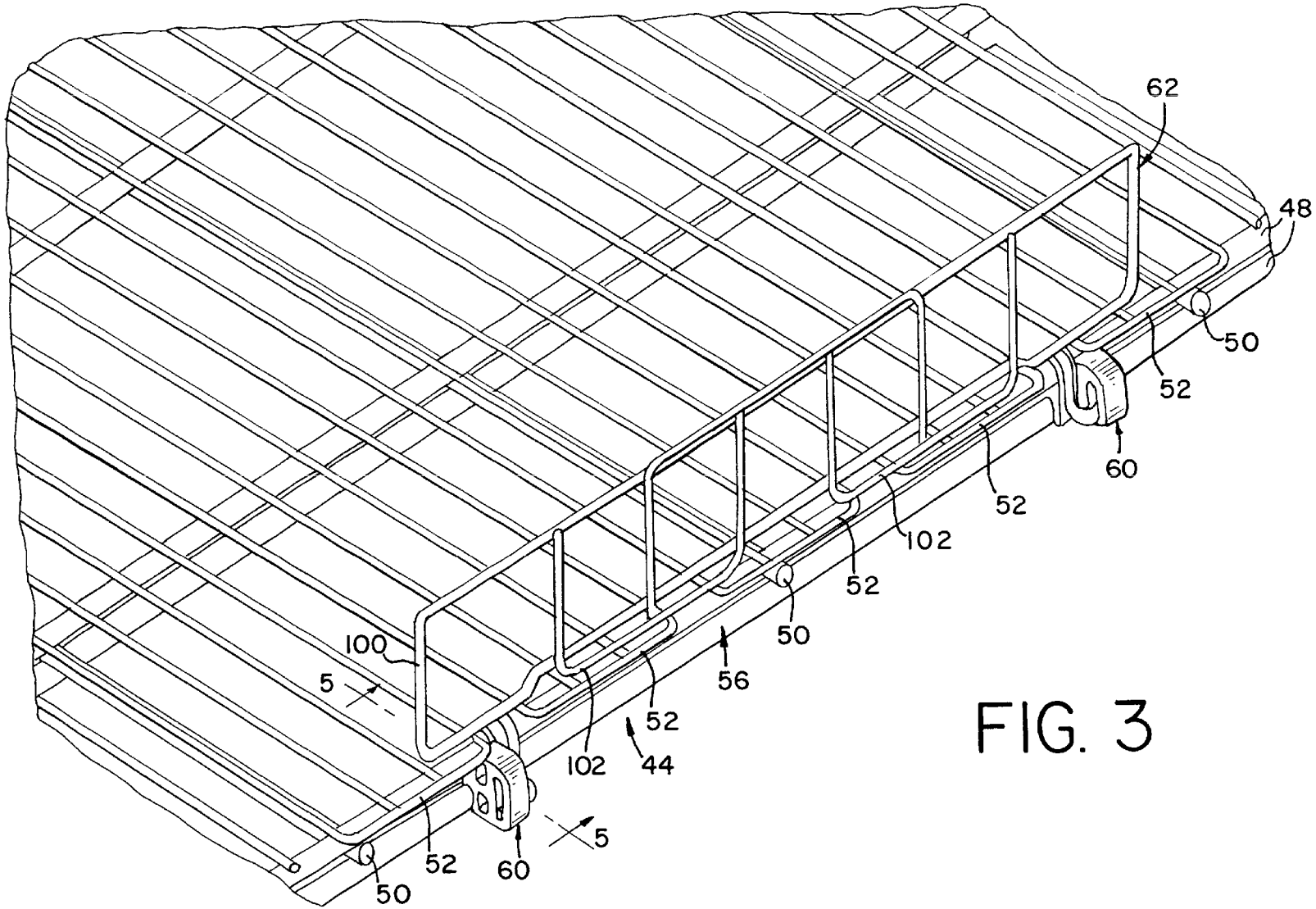
FIG. 3 is a partially broken away view of the shelf assembly of FIGS. 1–2 with the barrier member shown in the up position.
Figure 4:
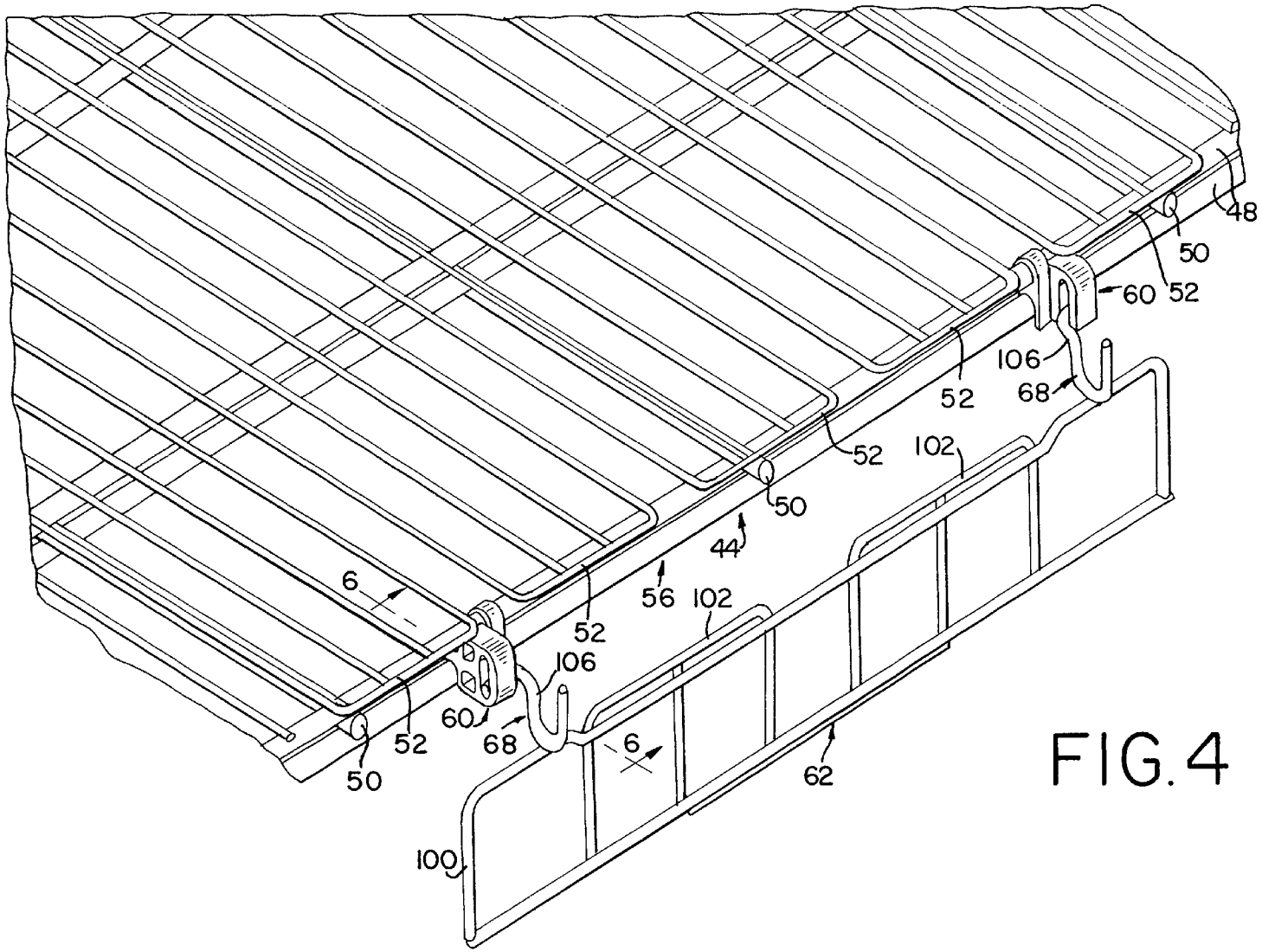
FIG. 4 is a partially broken away view of the shelf assembly of FIGS. 1–3 with the barrier member shown in the down position.

As best seen in FIGS. 3–4, the shelf 44 is formed from spaced outer rods 48, and a plurality of transversely extending rods 50 and the article support rods 52. The spaced outer rods 48 form the frame of the shelf 44 and are connected via the transversely extending rods 50. These elements form the first edge 56 of the shelf 44.

The spaced outer rods 48 and the transversely extending rods 50 are preferably formed from steel rods having a diameter of approximately ⅜". The article support rods 52 are preferably formed from steel rods having a diameter of approximately ⅛". The shelf 44 is constructed by bending the rods into the appropriate shapes and welding the assembly together. However, as those of ordinary skill in the art will recognize, the shelf 44 may be readily formed in other manners and in different configurations.

Figure 5:
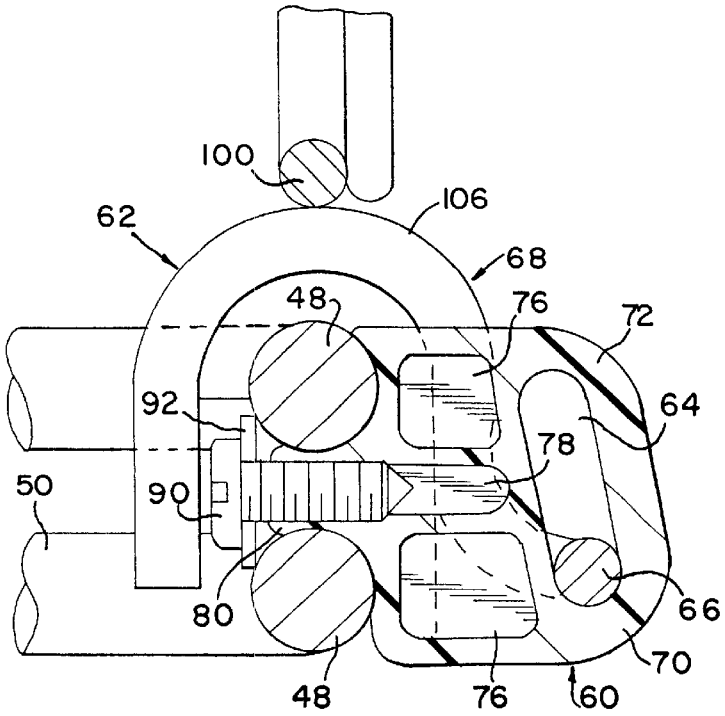
FIG. 5 is a partial cross-section of the shelf assembly taken along the lines 5—5 of FIG. 3.
Figure 6:
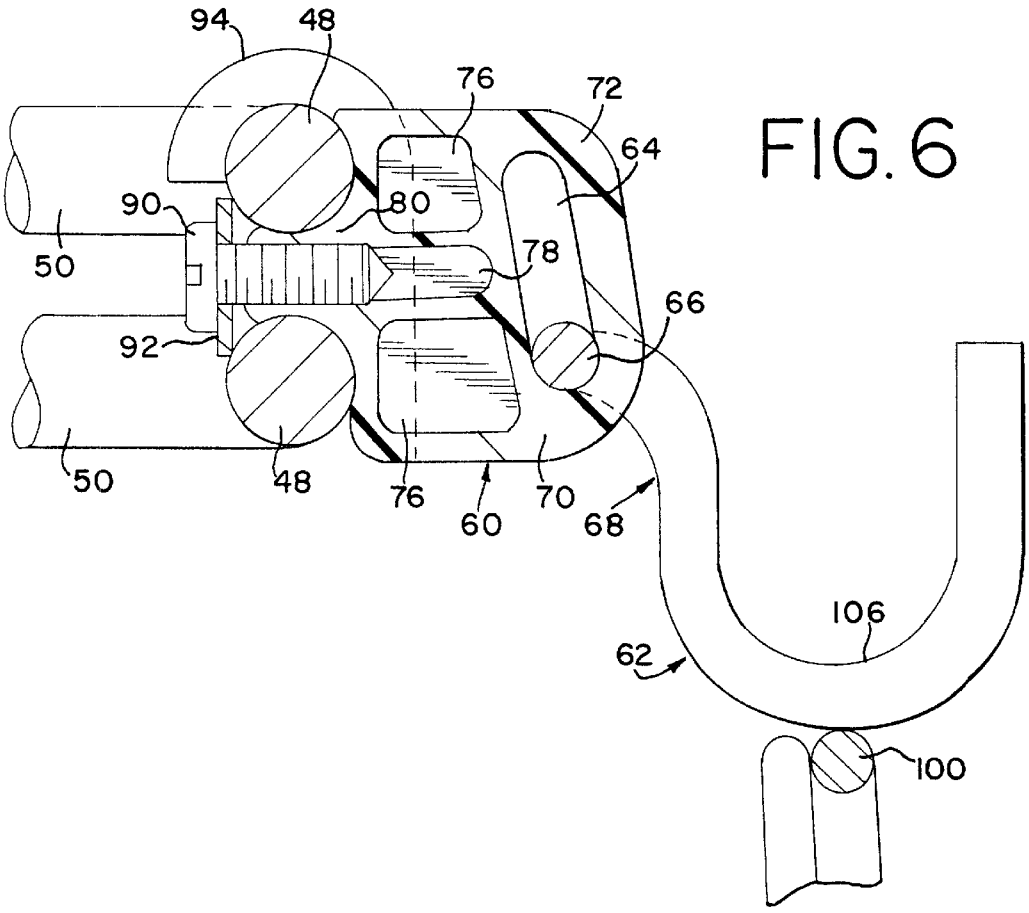
FIG. 6 is a partial cross-section of the shelf assembly taken along the lines 6—6 of FIG. 4.

A pair of mounting blocks 60 and a pivotable barrier member 62 or fence are attached to a first edge 56 of the shelf 44. As best seen in FIGS. 5–6, the mounting block 60 includes a channel 64 adapted to receive a portion 66 of the engagement member 68 of the barrier member 62. The channel 64 angles upward from a lower portion 70 of the mounting block 60 toward the first edge 56 of shelf 44 and an upper portion 72 of the mounting block 60. The mounting block 60 further includes two cavities 76 in order to save material during the formation of the mounting block 60. The cavities 76 preferably have a depth of approximately ⅜".

Figure 7:
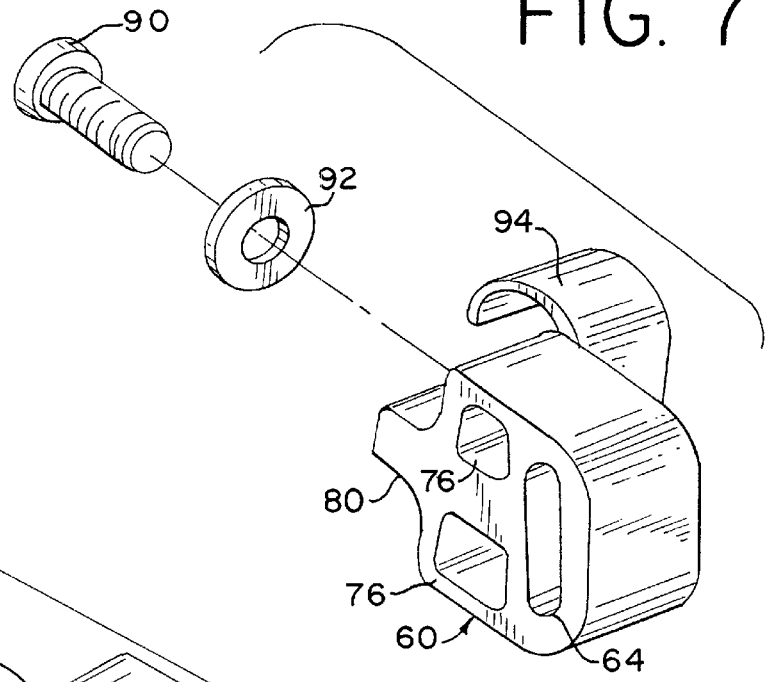
FIG. 7 is an exploded view of the mounting block and fastening element shown in FIGS. 1–6.
Figure 8:
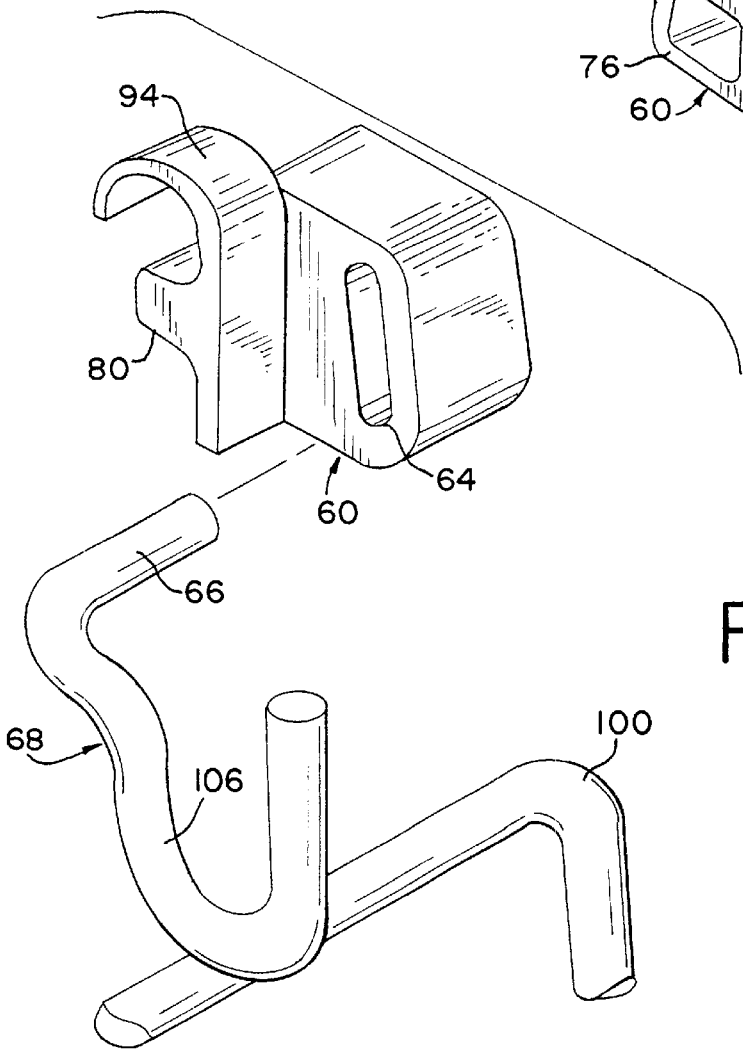
FIG. 8 is and exploded view of the mounting block and engagement portion of the barrier member shown in FIGS. 1–7.

A threaded aperture 78 extends within the portion 80 of mounting block 60 that is secured between the spaced outer rods 48. As best seen in FIGS. 5–7, a locking element, such as the screw 90 and washer 92, are used to secure the mounting block 60 to the first edge 56 of the shelf 44. As best seen in FIGS. 6 and 8, the mounting block 60 also includes a shoulder 94 having an inverted J-shape. The shoulder 94 is attached over one top spaced apart rod 48. The shoulder 94 protects the outer rods 48 from scratches that could be caused by the engagement member 68.

Preferably, the mounting block 60 is formed from Delrin™ plastic using an injection molding process. The mounting block 60 also preferably has a height of approximately 1⅛", and a length and width of approximately ⅞". In addition, the channel 64 preferably slants upward at a 10 degree angle.

FIGS. 3–6 and 8 best illustrate the construction of barrier member 62. The barrier member 62 includes a rectangular frame member 100 and crossing elements 102. The rectangular frame member 100 and crossing elements 102 are preferably formed from steel rods having diameters of 3⁄16" and ⅛", respectively. Preferably, the barrier member 62 has a length of approximately 15" and height of approximately 2". The barrier member 62 is constructed by bending the frame member 100 and crossing elements 102 into the desired configuration and welding the assembly together. However, the size and shape of the barrier member 62 may be readily changed to suit the needs of a particular shelf without departing from the spirit of the present invention.

The barrier member 62 also includes the engagement member 68. The engagement member 68 includes a portion 66 that is pivotably and slidably received within the channel 64. In addition, the engagement member 68 includes a U-shaped portion 106 that is sized to fit over the shoulder portion 94 of the mounting block 60. The frame member 100 is preferably welded to the bottom of the U-shaped portion 106. A steel rod having a diameter of 3⁄16" is preferably used to form the engagement member 68.

The use of barrier member 62 is best illustrated in FIGS. 3–6. As shown in these Figures, the barrier member 62 may be positioned in at least two positions. As shown in FIGS. 3 and 5, the barrier member may placed in an up or article-retaining position in order to protect any supplies located on the shelf 44 from possibly falling off the shelf 44. In this position, the U-shaped portion 106 of the engagement member 68 is secured over the shoulder 94 of the mounting block 60 in order to secure the barrier member 62 in this position. As shown in FIGS. 4 and 6, the barrier member 62 may be pivoted to a down or article-access position in order to provide a user with easier access to any supplies being stored on the shelf 44. In this position, the U-shaped portion 106 is disengaged from the shoulder portion 94 of the mounting block 60.

The barrier member 62 may be returned to the position shown in FIG. 3 by rotating it upward. One important aspect of the present invention is that the channel 64 includes a slight angle. In use, the portion 66 of the engagement member 68 slides downward when the barrier member 62 is lowered thereby securing the barrier member 62 in the down position. This construction allows the barrier member 62 to be securely retained on the shelf 44.

Figure 9:
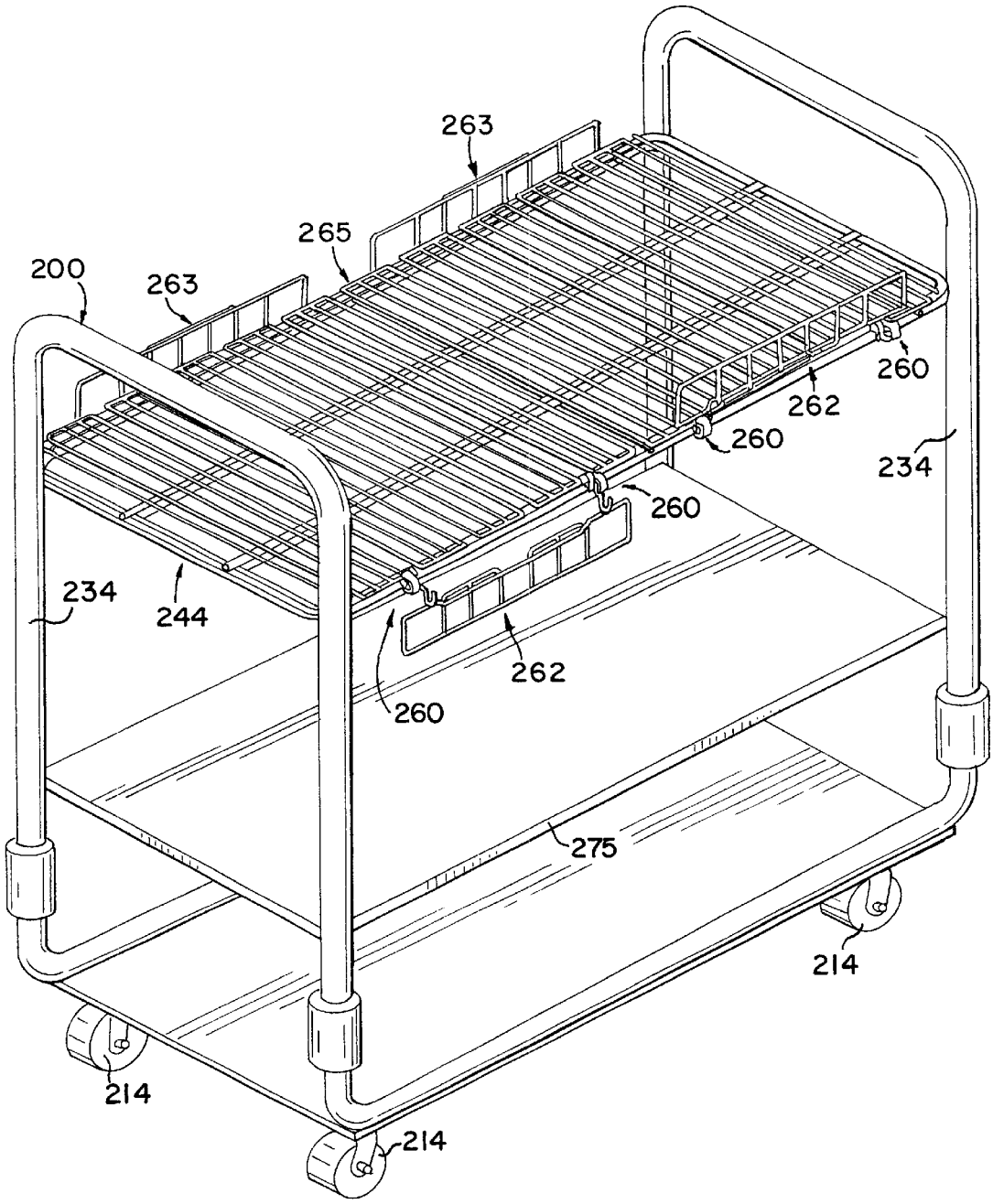
FIG. 9 is a front perspective view of another cart and shelf assembly illustrating another preferred embodiment of the present invention.

FIG. 9 is another embodiment of the present invention constructed in essentially the same manner as that described above except that the cart 200 is an open cart. The cart 200 includes casters 214, a support structure 234, a shelf 244, mounting blocks 260 and the barrier members 262. In addition, the cart 200 includes fixed or nonmovable barrier members 263 attached to second edge 265 of the shelf 244. A bottom shelf 275 is also shown on the cart 200. As one of ordinary skill in the art will recognize with respect to FIG. 9, the shelf assembly of the present invention can be used with carts of varying types. Moreover, the relative size of the barrier member could be easily varied to suit the length of a particular shelf.

The present invention may be embodied in other specific forms without departing from the spirit of the invention. For example, the particular configuration or construction of the shelf or barrier member could be easily modified for various uses. Therefore, it is intended that the foregoing detailed description be regarded as illustrative rather than limiting, and it is understood that the appended claims, including all equivalents, are intended to define the scope of the invention.

I claim:

1. A shelf assembly comprising:

a shelf having a first edge;

a mounting block attached to the first edge of the shelf, the mounting block having a shoulder portion that extends over the first edge; and a barrier member adapted to be attached to the mounting block, the barrier member capable of being oriented in at least two positions with respect to the shelf, the positions including an article retaining position and an article access position, the barrier member including a securement portion capable of engaging the shoulder when the barrier member is in the article retaining position.

2. The shelf assembly of claim 1 wherein the barrier member comprises an elongated rod formed into a rectangular shape and a plurality of spaced apart rods extending between a lower portion of the barrier member and an upper portion of the barrier member.

3. The shelf assembly of claim 2 wherein the barrier member is formed from rods having two different diameters.

4. The shelf assembly of claim 2 wherein the barrier member further comprises an engagement member adapted to be movably secured to the mounting block.

5. The shelf assembly of claim 4 wherein the mounting block includes a channel adapted to receive a portion of the engagement member.

6. The shelf assembly of claim 5 wherein the mounting block includes an inverted J-shaped portion extending over the first edge of the shelf.

7. The shelf assembly of claim 6 wherein the engagement member includes a U-shaped portion capable of extending over the J-shaped portion of the mounting block.

8. The shelf assembly of claim 7 wherein the first edge comprises two spaced apart rods extending in parallel to one another and connected by a plurality of traversely extending rods.

9. The shelf assembly of claim 8 wherein the mounting block includes a portion extending between the two spaced apart rods.

10. The shelf assembly of claim 9 further comprising a locking element extending between the two spaced rods and into an aperture within the mounting block.

11. The shelf assembly of claim 10 wherein the channel angles upward from a lower portion of the mounting block towards the first edge of the shelf and an upper portion of the mounting block.

12. A shelf assembly comprising:

a shelf having a first edge;

a first mounting block attached to the shelf, the first mounting block including a channel, the mounting block having a shoulder portion that extends over the first edge; and a barrier member having a first engagement member, the engagement member adapted to be pivotably attached within the channel of the first mounting block the barrier member including a securement portion capable of engaging the shoulder when the barrier member is in the artic retaining position.

13. The shelf assembly of claim 12 wherein the channel angles upward from a lower portion of the first mounting block towards the first edge of the shelf and an upper portion of the first mounting block.

14. The shelf assembly of claim 13 further comprising a second mounting block and the barrier member further comprising a second engagement member.

15. The shelf assembly of claim 14 wherein the barrier member is formed from rods having two different diameters.

16. The shelf assembly of claim 14 wherein the first and second mounting blocks have first and second shoulder portions that extends over the first edge of the shelf.

17. The shelf assembly of claim 16 wherein the first and second engagement members have first and second U-shaped portions capable of being secured to the first and second shoulder portions, respectively.

18. The shelf assembly of claim 17 wherein the first edge comprises two spaced apart rods extending in parallel to one another and connected by a plurality of traversely extending rods.

19. The shelf assembly of claim 18 wherein the first and second mounting blocks include a portion extending between the two spaced apart rods.

20. The shelf assembly of claim 19 further comprising first and second locking elements extending between the two spaced rods and into apertures within the first and second mounting blocks.

* * * * *